United States Patent [19]

Curl et al.

[11] Patent Number: 5,019,805

[45] Date of Patent: May 28, 1991

[54] SMOKE DETECTOR WITH STROBED VISUAL ALARM AND REMOTE ALARM COUPLING

[75] Inventors: Ricky L. Curl, Pinson; Lowell E. Roberts, Irondale, both of Ala.

[73] Assignee: Flash-Alert Inc., Birmingham, Ala.

[21] Appl. No.: 305,916

[22] Filed: Feb. 3, 1989

[51] Int. Cl.[5] ..... G08B 17/10

[52] U.S. Cl. ..... 340/628; 340/531; 340/331

[58] Field of Search ..... 340/628, 629, 630, 326, 340/331, 332, 531; 315/308

[56] References Cited

U.S. PATENT DOCUMENTS

| | | | |
|---|---|---|---|
| Re. 30,620 | 5/1981 | Sweany et al. | 340/628 |
| 3,564,524 | 2/1971 | Walthard et al. | 340/629 |
| 3,566,390 | 6/1968 | Zevas et al. | 340/330 |
| 3,676,681 | 7/1972 | Kobayashi | 340/629 |
| 3,810,170 | 5/1974 | Zinsmeister | 340/331 |
| 3,872,449 | 3/1975 | Scheidweiler | 340/629 |
| 4,004,288 | 1/1977 | Webb, Jr. | 340/628 |
| 4,074,225 | 2/1978 | Vandeweghe | 340/628 |
| 4,093,943 | 6/1978 | Knight | 250/574 |
| 4,096,473 | 6/1978 | Sweany et al. | 340/628 |
| 4,097,851 | 6/1978 | Klein | 340/628 |
| 4,148,023 | 4/1979 | Elkin | 340/326 |
| 4,160,246 | 7/1979 | Martin et al. | 340/630 |
| 4,162,489 | 7/1979 | Thilo et al. | 340/518 |
| 4,283,657 | 8/1981 | Gordon et al. | 340/628 |
| 4,288,791 | 8/1981 | Malinowski | 340/630 |
| 4,305,069 | 12/1981 | Machen et al. | 340/628 |
| 4,316,179 | 2/1982 | Bliss et al. | 340/538 |
| 4,321,595 | 3/1982 | Tresch | 340/630 |
| 4,365,238 | 12/1982 | Kollin | 340/512 |
| 4,401,979 | 8/1983 | Dobrzanski | 340/629 |
| 4,404,550 | 9/1983 | Shaw | 340/628 |
| 4,422,016 | 12/1983 | Kurple | 315/308 |
| 4,471,346 | 9/1984 | Nelson et al. | 340/628 |
| 4,489,308 | 12/1984 | Logan, Jr. et al. | 340/331 |
| 4,531,114 | 7/1985 | Topol et al. | 340/628 |
| 4,538,137 | 8/1985 | Kimura | 340/512 |
| 4,556,873 | 12/1985 | Yamada et al. | 340/630 |
| 4,635,040 | 1/1987 | Masot | 340/533 |
| 4,680,576 | 7/1987 | Bauer | 340/630 |
| 4,688,021 | 8/1987 | Buck et al. | 340/628 |
| 4,737,769 | 4/1988 | Masot | 340/533 |
| 4,755,792 | 7/1988 | Pezzolo et al. | 340/538 |
| 4,763,115 | 8/1988 | Cota | 340/628 |
| 4,796,018 | 1/1989 | Nakanishi et al. | 340/628 |
| 4,812,821 | 3/1989 | Santy et al. | 340/310 CP |

*Primary Examiner*—Joseph A. Orsino
*Assistant Examiner*—Jill Jackson
*Attorney, Agent, or Firm*—Dann, Dorfman, Herrell and Skillman

[57] ABSTRACT

The smoke detector of the present invention is designed to warn hearing impaired persons of fire or smoke. A small, attractive, and inexpensive wall or ceiling mounted unit houses a dual chamber ionization detector, piezoelectric alarm horn, and a high intensity xenon strobe unit producing approximately 130 candela. In one embodiment, it is powered only from standard 120 volt AC power, although an internal battery standby version and low voltage D.C. version are alternative embodiments. The unit is furnished with a surface mount housing. It can easily be moved from room to room as required and it is intended to be easily hung on the wall about a foot from the ceiling.

5 Claims, 5 Drawing Sheets

FIG. 2
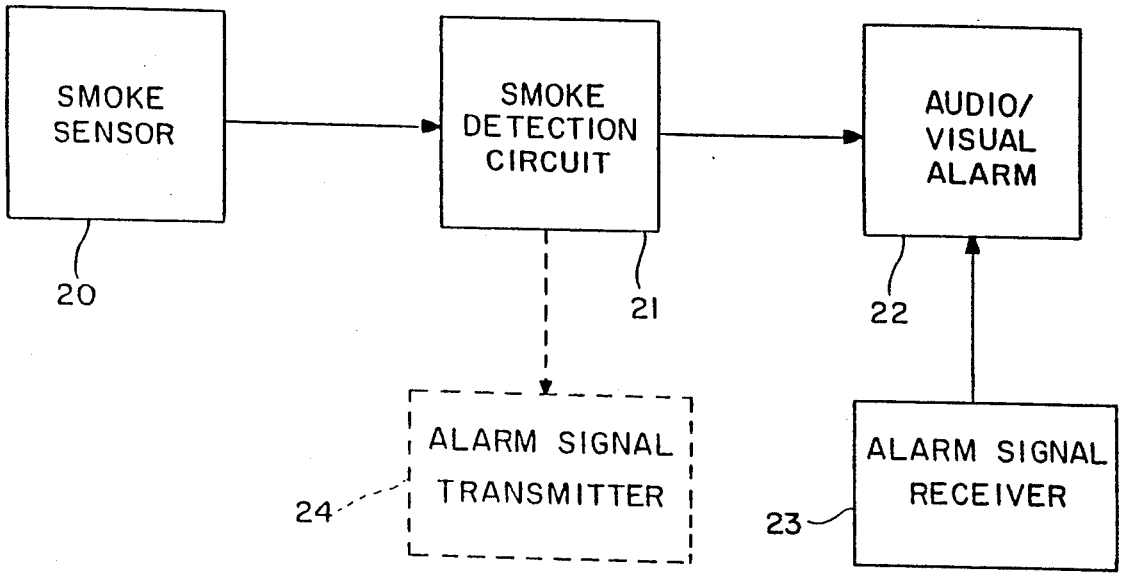
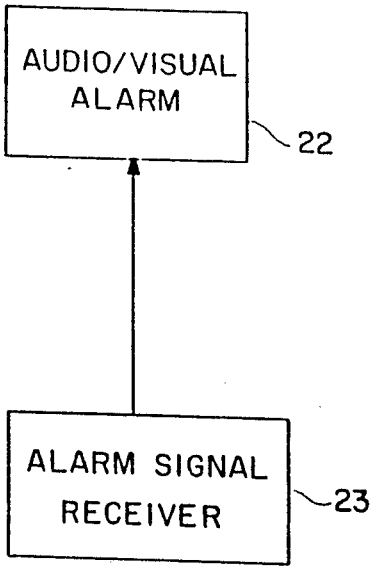
FIG. 2A
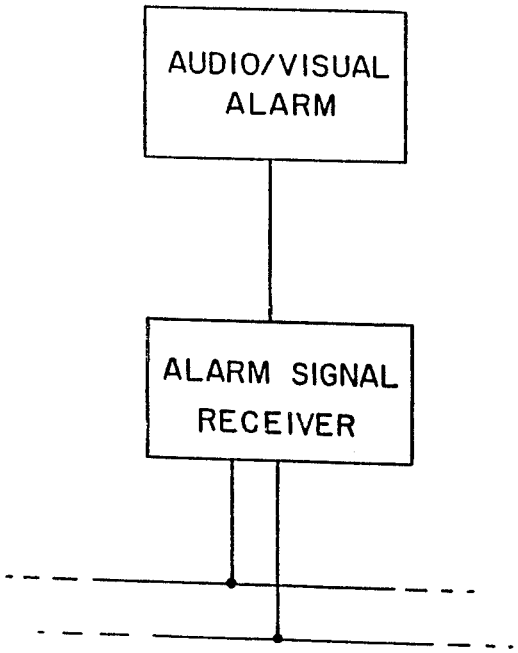
FIG. 3A

SMOKE DETECTOR WITH STROBED VISUAL ALARM AND REMOTE ALARM COUPLING

TECHNICAL FIELD OF THE INVENTION

The present invention relates in general to smoke detectors and, more particularly, to a unitary visual signalling smoke detector which can be used alone or in communication with other remotely located, similar smoke detector units.

BACKGROUND OF THE INVENTION

Persons having reduced or totally impaired hearing faculties are often at risk of not being notified of dangerous smoke or fire conditions detected by conventional audible smoke alarms. The risk is particularly apparent when hearing impaired persons are travelling overnight and find need to stay in hotels, motels, inns or the private homes of friends. Such accommodations may not have sufficient facilities for alerting hearing impaired guests in the event of emergency due to fire or smoke.

There are at least two potentially tragic situations of particular concern to the hearing impaired. One situation involves smoke and fire overcoming the hearing impaired person in his or her own room because the audible alarm signal produced by the smoke detector in the room could not be heard by the person, for example while sleeping. Another situation involves fire or smoke activating an audible alarm smoke detector located in a remote part of the building. The hearing impaired person, being unaware of the emergency condition, may be needlessly trapped by an ensuing inferno.

Some previous visual signalling systems for the hearing impaired require that separate units be hard wired together, which requires unsightly wires to be installed around walls and stairwells or requires expensive rewiring of established buildings. In addition, these systems are not readily transferrable to other buildings and thereby have limited utility. One such system is described in U.S. Pat. No. 3,810,170, issued to R. F. Zinsmeister on May 7, 1974, in which the system is intended to be installed in buildings, such as dormitories, specifically designed to be occupied by hearing impaired persons.

Another visual signalling system, disclosed in U.S. Pat. 4,365,238, issued to Kollin on Dec. 21, 1982, for hearing impaired involves several sound detector devices to detect the audio emissions of various sources of sound, such as an audio alarm smoke detector, and to transmit a radiowave signal indicative of the type of sound detected to a central logic unit. The central logic unit then transmits a signal over the electrical power lines of a building to turn household lamps on and off at a predetermined frequency to convey to a hearing impaired person what type of audio event has taken place. This system requires at least three modules to operate and requires careful and arduous set-up. The Kollin system requires a central logic unit, a separate sound detector device for each source of sound which is to be placed adjacent the source of sound, and control modules to receive commands over the electrical power lines from the central logic unit and to switch a lamp on and off at a predetermined frequency. Thus, the Kollin system is bulky, inconvenient to transport and relies on preexisting smoke detectors and lamps that may not be available.

An object of the present invention is to avoid the hazards and deficiencies of the previous smoke detector systems.

Another object of the present invention is to provide a smoke detector unit with a extremely high intensity visual alarm wherein the unit can operate alone, or in conjunction with other similar units without requiring special wiring or special central control units.

Another object of the present invention is to provide a compact smoke detector unit which can be easily transported and quickly installed in virtually any room so that any one room or building need not be specially equipped and dedicated for use by hearing impaired persons.

A further object of the present invention is to provide a smoke detector unit which can be supplied to hearing impaired customers by public lodging facilities or carried by the hearing impaired person in his luggage or on his person.

SUMMARY OF THE INVENTION

The present invention fulfills the abovementioned objects, among others, by providing a self-contained, unitary smoke detector having an audio alarm and a strobe light alarm. The smoke detector unit also includes a dual chamber ionization type smoke sensor and an alarm signal transmitter and receiver. When the smoke sensor detects a threshold level of smoke, it produces an alarm signal which activates the strobe light and the audio alarm of the unit. The alarm signal can be transmitted to receiving circuits of remotely located units via audible signals, radio frequency signals or over the preexisting electrical power lines of the building. The smoke detector units are powered by battery or by standard house wiring via a 12-foot parallel cord or "zip" cord and wall receptacle. The plug-in embodiment may, additionally, have a back-up battery operated power system. Thus, the smoke detector unit is fully functional alone, but a smoke detector network can be readily developed by simply associating other such units within the same audio range, radio frequency or power line network without requiring additional circuitry or hardware.

BRIEF DESCRIPTION OF THE DRAWINGS

FIGS. 2 and 2*a* are block diagrams illustrating a unitary, wireless smoke detector and an alarm relay for use in a multidetector system in accordance with the present invention.

FIGS. 3 and 3*a* are block diagrams illustrating a smoke detector system using power line communication in accordance with the present invention.

DETAILED DESCRIPTION OF THE PRESENT INVENTION

Figure 1:
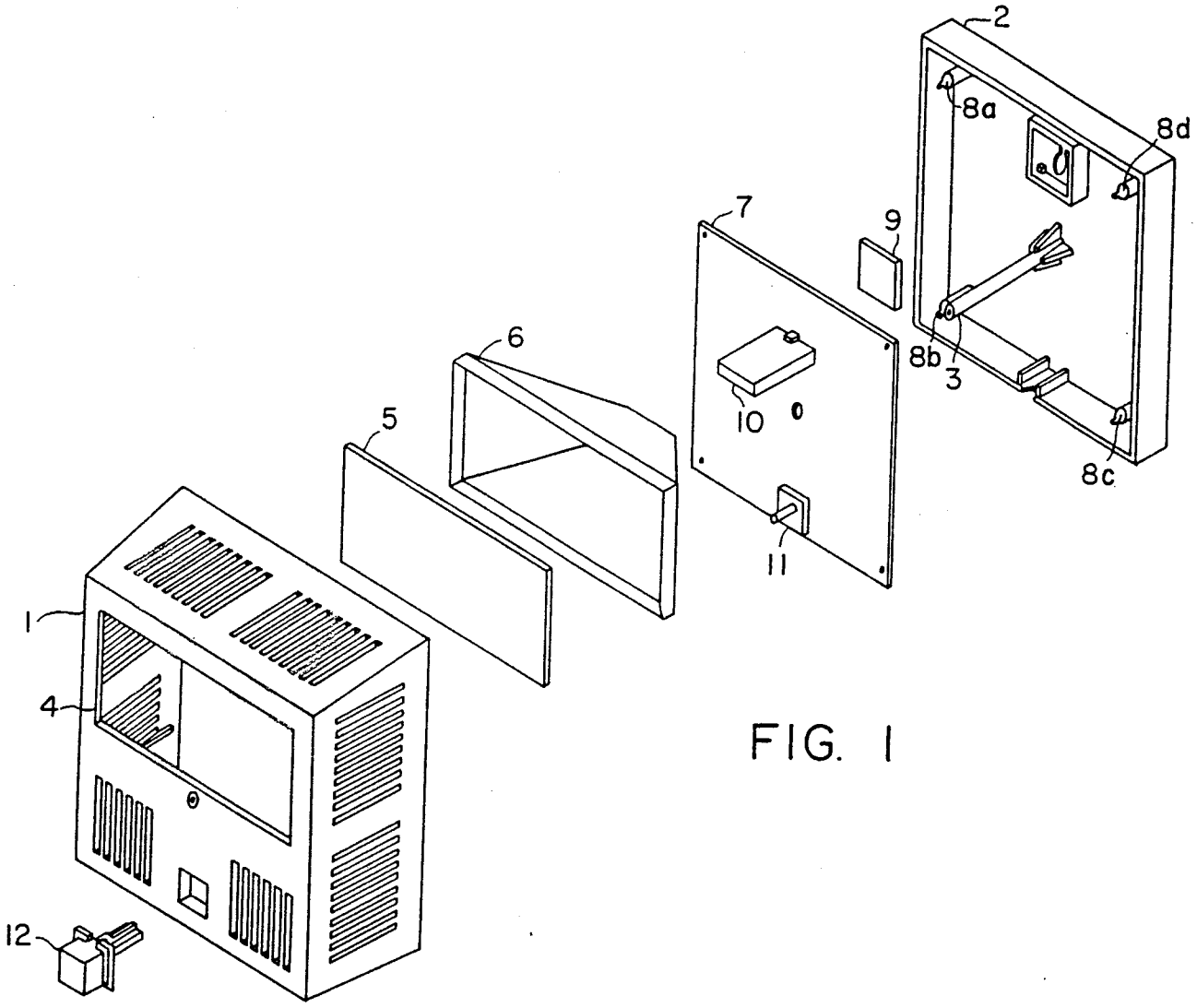
FIG. 1 is an isometric view of the housing components of a visual smoke alarm constructed in accordance with the present invention.

The surface mount housing unit for a visual smoke alarm in accordance with the present invention is shown in an exploded view in FIG. 1. The housing unit is formed by affixing a cover 1 including a face and integral side panels to a base 2 by way of a fastening pin 3. A multitude of slots are formed in the face and side panels of the cover 1 to allow the passage of smoke into the ionization chamber of the smoke sensor. A window 4 is also formed in the face of the cover 1 to allow passage of the light from the strobe 10. A clear lens 5 and a reflector 6 are mounted in the window 4 for focusing and directing the strobed light. A circuit board 7 is mounted by means of indexing pins 8*a*–8*d* to the inner face of the base 2 of the housing unit. The base 2 includes a hanger slot for rapid and easy mounting of the housing unit to a projection from the wall or ceiling of a room. A hanger slot cover 9 is affixed adjacent to said hanger slot to prevent unwanted debris from entering the housing unit.

On the circuit board 7, the xenon strobe light 10 is mounted and positioned to be accepted into the reflector 6. A test switch 11 is also mounted on the circuit board and a push button 12 is mounted on the face of cover 1 to actuate the test switch 11.

The general circuit layout of the smoke detector unit is shown in FIG. 2. The smoke sensor section 20 detects the level of smoke present in the environment and sends a smoke level signal to the smoke detector circuit 21. The smoke detector circuit 21 compares the smoke level signal to a threshold level. If the smoke level signal exceeds the threshold level, an alarm signal is generated and sent to an audio/visual alarm generator 22. Alternatively, the alarm signal is also sent to an alarm signal transmitter 24. The alarm signal is transmitted by the audio alarm generator 22 or by transmitter 24 to be received by the alarm signal receivers 23 of remotely located alarm units in order to activate the remotely located audio/visual alarm indicator, thereby alerting every person, hearing impaired or not, in the area in which the smoke detector network is present.

The remotely located alarm units may be smoke detectors complete with a smoke sensor section 20 and a smoke detector circuit 21 as well as the receiver 23 and optionally a separate transmitter 24. Alternatively, the alarm units may not be smoke detectors, but simpler alarm relays including an alarm signal receiver 23, an audio/visual alarm generator 22 and optionally a separate transmitter 24. The latter embodiment permits construction of a smoke alarm network which is relatively less expensive than the smoke detector network mentioned above. The smoke detector can be strategically positioned in the building or detectors can be strategically positioned throughout the building and the alarm relays can be placed in other areas or locations frequented by people or even transported by people as they move about the building. A network can be composed of a mixture of smoke detectors and alarm relays to provide a more complete safeguard against smoke and fire. The alarm relays can operate with conventional audio alarm smoke detectors by adjusting or adapting the alarm signal receiver 23 to respond to the audio alarm of the relay are shown in FIGS. 2*a* and 3*a*.

The transmitted alarm signal can be in the form of radiowave transmissions or audio transmissions in the embodiment of FIG. 2. Radiowave transmissions and receiving means are well-known and need not be discussed in detail.

The audio transmission and reception embodiment is preferred because a separate alarm signal transmitter is not required. In the preferred embodiment, the audio section of the audio/visual alarm additionally functions to transmit the alarm signal to remotely located smoke detector units. The audible alarm signal is transmitted at a discrete, preselected frequency which is modulated into a predetermined series of on/off cycles. The audio receiver 23 is tuned to the preselected audio frequency and responds to the audio alarm signal after five or more on/off cycles have been uninterruptedly detected. By transmitting and detecting audio signals of discrete frequency and modulated in predetermined cycles, the number of false alarms due to ambient noise is substantially reduced.

The audio transmitter can be any suitable form of audio generator, but preferably it is a piezoelectric transducer and a crystal modulating circuit for outputting a distinguishable audio output signal. The audio receiver can be any suitable form of microphone, but preferably it is of the piezoelectric type shown in FIG. 5.

Figure 5:
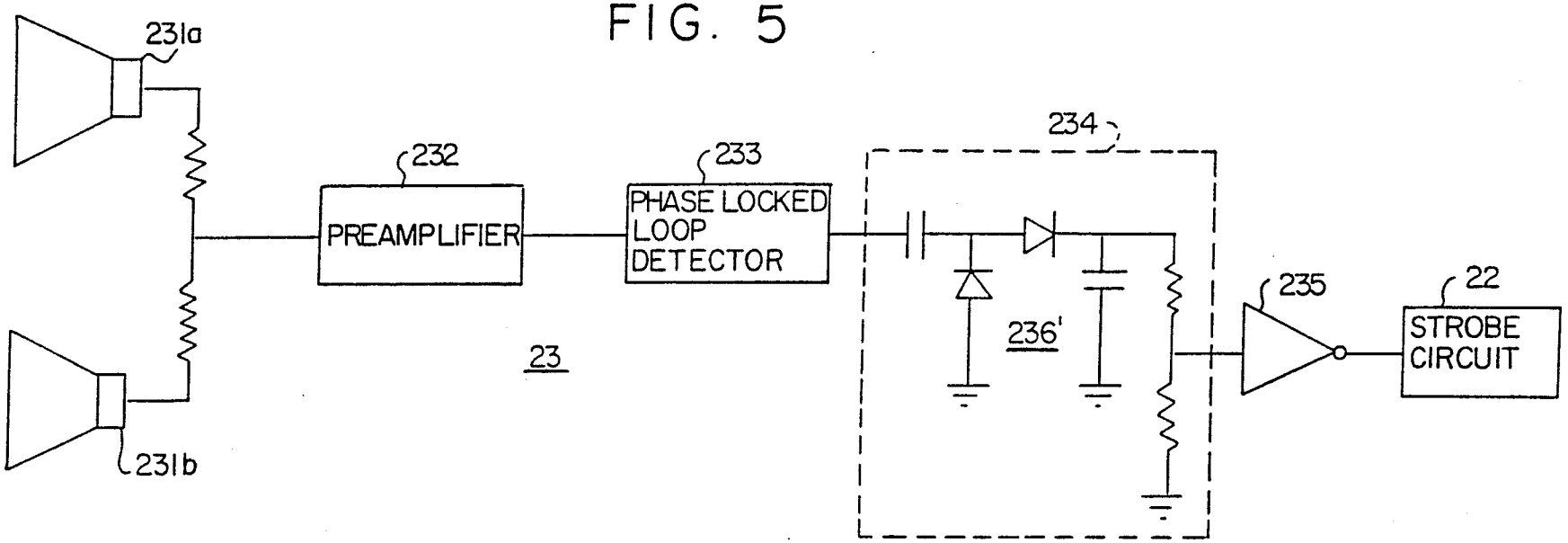
FIG. 5 is a block diagram illustrating an audio receiver of the relay embodiment shown in FIG. 2*a* in accordance with the present invention.

As shown in FIG. 5, the audio receiver 23 of the alarm relay embodiment shown in FIG. 2*a* (though a substantially similar design could be used in the embodiment of FIG. 2) acts as an audibly-triggered remote slave indicator. The audio receiver 23 has two piezoelectric transducers 231*a* and 231*b* to sense the audible alarm tone. Two piezoelectric transducers are used instead of one because in certain limited areas of a room a pure tone cancels itself out. The two transducers 231*a* and 231*b* are placed several inches apart to insure that at least one of the transducers will be able to receive the audible alarm signal. The transducers used to receive an audible alarm are of the same type, i.e. has the same physical characteristics, as is used in the smoke detector to generate an audible alarm. This approach is used because the transducers are very tightly tuned and can sense only their fundamental frequency.

The two piezoelectric transducers 231*a* and 231*b* are connected to a preamplifier circuit 232 for amplification of the sensed signal. The amplified signal is input to detector 233 to compare the phase of the signal sensed by the transducers 231*a* and 231*b* with a reference signal to determine if the sensed signal has the same tone as an audible alarm signal. The detector 233 is preferably of the phase locked loop type, but could be a crystal controlled, switched capacitor filter followed by a Schmitt trigger envelope detector.

The output of the detector 233 is input to a phase discriminator 234. The phase discriminator 234 is used to trigger a strobe circuit 22 via a multivibrator 235 after about five on/off cycles of an audible alarm. At the end of the predetermined number of on/off cycles, sufficient charge is accumulated in the capacitor 236 of the phase discriminator 234 to trigger the strobe circuit 22. The phase discriminator 234 turns off the strobe circuit 22 a few seconds after the last sensed on/off cycle when the accumulated charge in the capacitor 236 has dissipated.

The output of the phase discriminator 234 is input to the multivibrator 235 which is preferably a single shot multivibrator such as a Schmitt trigger. The constant amplitude output of the Schmitt trigger lasts as long as the input signal (i.e. the sensed and discriminated audible alarm) lasts. The output of the multivibrator 235 triggers a strobe circuit 22 of substantially identical design as that described in connection with FIG. 4.

Figure 3:
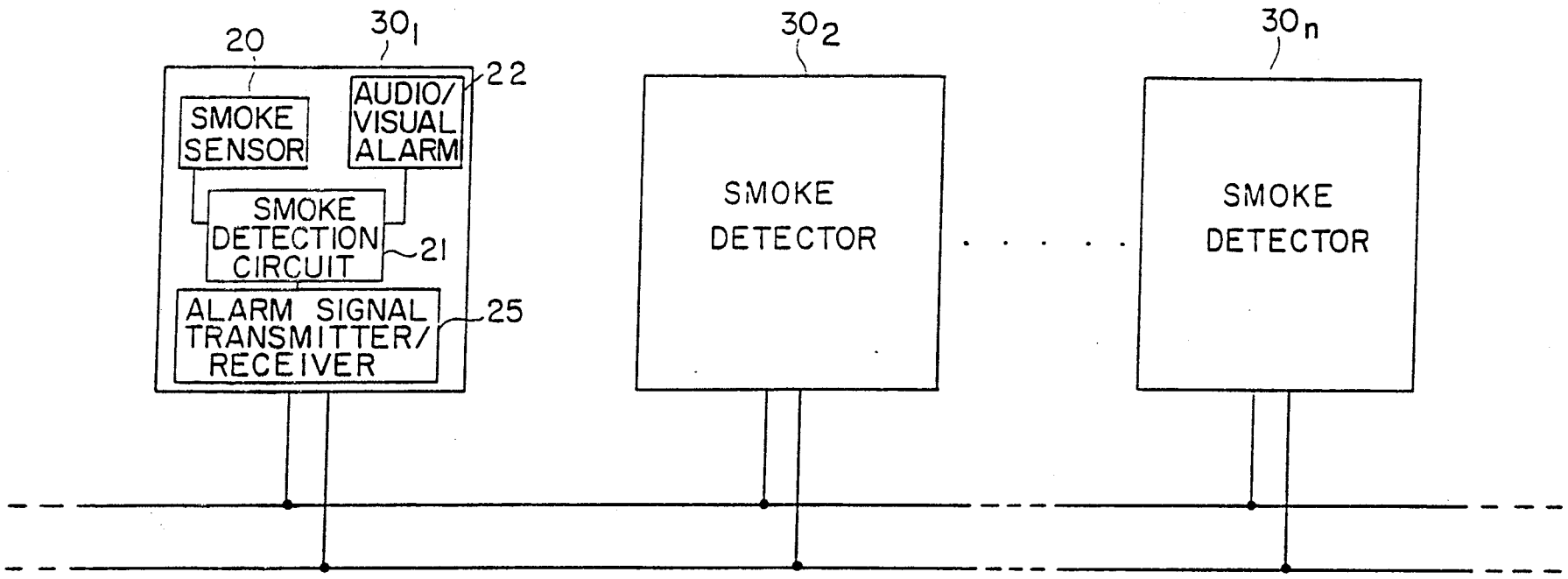

An alternative embodiment using power line communication (PLC) is shown in FIG. 3. In the alternative embodiment, power line communication technology is used to reliably transmit the alarm signal between remotely located smoke detector units. The alarm signal is communicated over the power lines by superimposing a digital encoded high frequency (e.g. around 100 KHz) carrier signal into the 60 Hz AC power lines. The alarm signal is transmitted by the alarm signal transmitter/-receiver circuit 25 of the smoke detector unit in the event that the unit detects the presence of a threshold level of smoke. The transmitted alarm signal is detected by the alarm signal transmitter/receiver circuit 25 of remotely located smoke detector units as shown in FIG. 3 or alarm units as shown in FIG. 3*a* to subsequently activate their audio/visual alarm generator 22.

Figure 4:
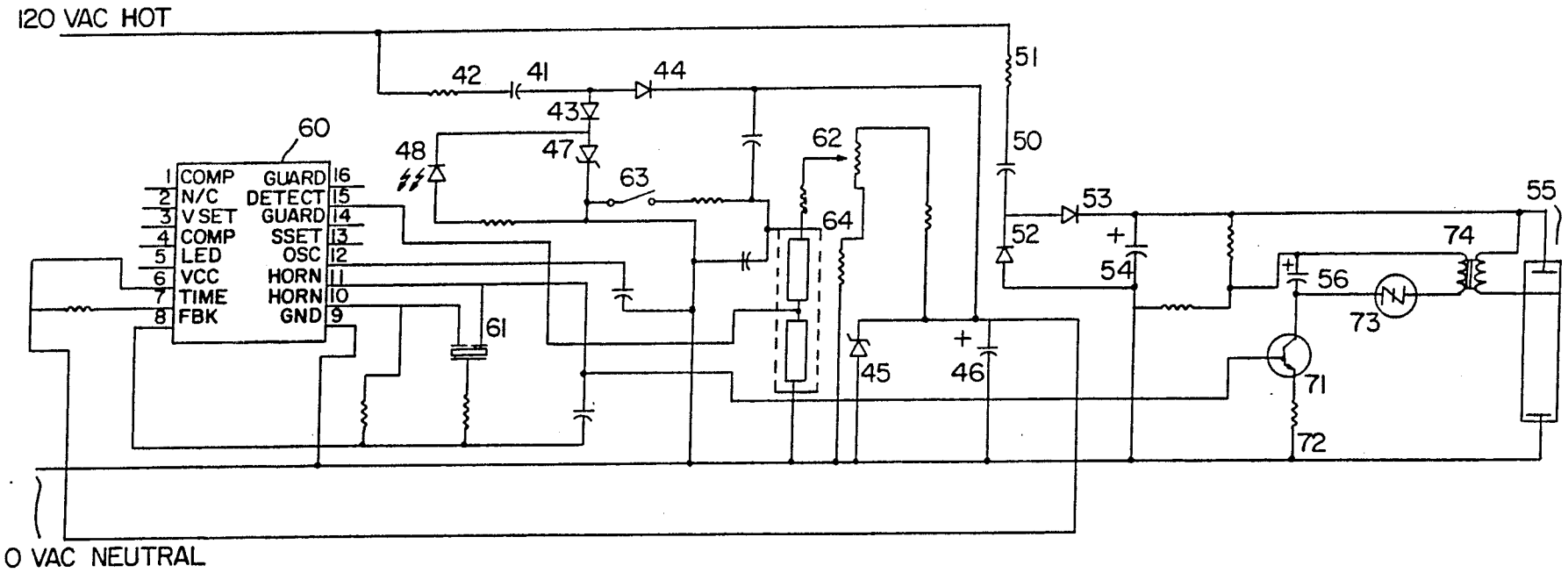
FIG. 4 is a schematic diagram of the smoke sensor, smoke detection and audio/visual alarm generating circuit.

In FIG. 4, the smoke detector is divided into three groups of circuits, namely a power supply circuit, a smoke detector circuit, and a visual signal circuit.

Power Supply Circuit

The low voltage section comprises a series connected non-polar metallized polyester capacitor 41 and flame-proof resistor 42 to limit the available current to a diode pair 43, 44. A Zener diode 45 limits the voltage to 9 volts, and a filter capacitor 46 removes voltage ripple. The Zener diode 47 limits the current to an LED power on indicator 48.

The high voltage section is similar in layout to the low voltage section, but a larger input capacitor and the absence of a zener clamp cause this supply to function as a voltage doubler rather than a step-down supply. A capacitor 50 and a resistor 51 limit current into a pair of diodes 52, 53. A capacitor 54 is an energy storage capacitor for firing a xenon flashtube 55. The nominal voltage developed across the capacitor 54 can be about 360 volts D.C., for example.

Power is supplied to the power supply circuit either by a low voltage battery and step-up converter (not shown) for stand-alone operation or by tapping into the electrical power conductors of the household wiring with a cord plugged into a household receptacle. The power supply of the preferred embodiment shown in FIG. 4 is adapted to be plugged into a conventional wall receptacle and accordingly receives primary power from the standard 120-volt, 60 cycle AC signal. In the event of a loss of primary power, a battery source can also be provided as backup (not shown).

Smoke Detector Circuit

Any suitable smoke detector circuit can be utilized, including either photoelectric type or ionization type. However, in the preferred embodiment shown in FIG. 4, the circuit is built around a Motorola MC14467 ionization-type smoke detector chip 60. This integrated circuit 60 is intended to be used in stand alone battery operated smoke detectors but is adapted for the plug-in embodiment in FIG. 4. The ionization-type sensor 64 is the dual chamber type which produces an output voltage of about 50% of the bias voltage when the chambers are in balance. In the presence of smoke, the balance is upset, thereby reducing the output voltage and tripping an internal comparator in smoke detector chip 60. The comparator drives a pulsing oscillator which in turn regenerates an alarm signal to drive a piezoelectric transducer 61 to provide an audible alarm signal. A variable resistor 62 is optional for providing sensitivity calibration of the ionization type sensor 64, but may be omitted by tying together the three leads leading to it. A circuit testing switch 63 is also provided.

Visual Signal Circuit

A voltage signal is taken from one of the transducer driver outputs to act as an alarm signal in order to bias a high voltage transistor 71 to its conductive or switched on state. The transistor 71 forms a constant current sink or switch activated for charging a timing capacitor 56. It is important that the flash rate be constant over widely varying input voltages. If the flash rate is too fast, the resistor 51 and the flashtube 55 may be stressed beyond their ratings. If the flash rate is too slow, the strobe may not meet appropriate regulatory requirements. The current of the constant current sink (and flash rate) is set by a resistor 72.

Each time the voltage across the timing capacitor 56 charges to a threshold level, e.g. 150 volts, a snap diode 73 becomes conductive providing a switch to complete a circuit for discharging the charge stored in the timing capacitor 56 into the primary winding of a trigger transformer 74. The resulting high voltage trigger pulse at the output of the transformer 74 triggers the flashtube 55. The flashtube 55 goes into low impedance arc mode permitting discharge of the capacitor 54 to produce a brilliant flash of at least 100 candela, and preferably about 130 candela. The light from the flash is designed to be bright enough to alert people even when they are looking away from the visual alarm and even when they are asleep. When the voltage across the capacitor 54 has dropped to a low value, the arc can no longer be sustained and extinguishes itself. The capacitor 54 then recharges to be ready for the next discharge cycle. Alternatively, the strobe can be triggered by maintaining the same charge level on the capacitor 54 before discharge and triggering the strobe by a sequence of square wave pulses output by the transducer driver signal output of the smoke detector chip 60.

It is contemplated that, after having read the preceding disclosure, certain alterations and modifications of the present invention will become apparent to those of ordinary skill in the art. It is therefore intended that the following claims be interpreted to cover all such alterations and modifications as fall within the true spirit and scope of the invention.

What is claimed is:

1. A portable, smoke detector and alarm unit comprising:

(a) smoke sensor means for sensing the presence of smoke and outputting a smoke indicator signal;

(b) smoke detection means responsive to the smoke indicator signal from said smoke sensor means for comparing the smoke indicator signal with a predetermined threshold and outputting a first alarm signal when said smoke indicator passes said threshold;

(c) a strobe light for providing a visual alarm;

(d) a power supply;

(e) triggering means responsive to the first alarm signal for providing a triggering signal to said strobe light such that said strobe light is triggered to flash at a substantial constant rate, said triggering means including:

(i) a timing capacitor operatively coupled to the power supply and to a trigger electrode of said strobe light;

(ii) first switch means operatively connected to said timing capacitor and responsive to the first alarm signal for enabling said timing capacitor to charge to at least a threshold voltage to trigger said strobe light;

(iii) second switch means responsive to the voltage across said timing capacitor and activated to complete a circuit to cause discharging of said timing capacitor when the timing capacitor voltage is at least at the threshold voltage to trigger said strobe light for flashing; and (f) an energy storage capacitor connected to the power supply and to said strobe light for storing electrical energy independently of said first alarm signal to flash said strobe light when triggered.

2. A portable, smoke detector and alarm unit as recited in claim 1 further comprising means for transmitting an audible alarm signal in response to the first alarm signal.

3. A portable, smoke detector and alarm unit as recited in claim 2 further comprising:

receiver means for receiving an audible alarm signal from a remotely disposed smoke detector and outputting a second alarm signal to said triggering means.

4. A portable, smoke detector and alarm unit as recited in claim 1 wherein the power supply comprises a voltage doubler circuit for maximizing the electrical energy stored by said energy storage capacitor such that the brilliance of the strobe light is maximized when flashed.

5. A portable, smoke detector and alarm unit as recited in claim 1 wherein said first switch means comprises a constant current sink whereby the timing capacitor is charged to at least the threshold voltage at a constant current in response to the first alarm signal.

* * * * *

UNITED STATES PATENT AND TRADEMARK OFFICE

CERTIFICATE OF CORRECTION

PATENT NO. : 5,019,805

DATED : May 28, 1991

INVENTOR(S) : CURL and ROBERTS

It is certified that error appears in the above-identified patent and that said Letters Patent is hereby corrected as shown below:

Column 2,

Line 22, "abovementioned" should be --above-mentioned--.

Column 3,

Line 58, after "audio alarm of the" insert --conventional smoke detector. Examples of an alarm--.

Column 5,

Line 63, "regenerates" should be --generates--.

Column 6,

Line 26, after "candela" insert --or more--.

Column 6, line 54, after "indicator" insert --signal--;
line 61, "substantial" should be --substantially--.

Column 7, line 2, after "said strobe light;" insert --and--.

Signed and Sealed this

Twentieth Day of October, 1992

*Attest:*

DOUGLAS B. COMER

*Attesting Officer*

*Acting Commissioner of Patents and Trademarks*